US007495637B2

(12) United States Patent
Kim et al.

(10) Patent No.: US 7,495,637 B2
(45) Date of Patent: Feb. 24, 2009

(54) DRIVING METHOD AND APPARATUS OF PLASMA DISPLAY PANEL

(75) Inventors: Dae Hyun Kim, Goonpo-si (KR); Geun Soo Lim, Sungnam-si (KR)

(73) Assignee: LG Electronics Inc., Seoul (KR)

( * ) Notice: Subject to any disclaimer, the term of this patent is extended or adjusted under 35 U.S.C. 154(b) by 730 days.

(21) Appl. No.: 10/791,573

(22) Filed: Mar. 3, 2004

(65) Prior Publication Data

US 2004/0174322 A1 Sep. 9, 2004

(30) Foreign Application Priority Data

Mar. 4, 2003 (KR) ..... 10-2003-0013365

(51) Int. Cl.
*G09G 3/28* (2006.01)

(52) U.S. Cl. ..... 345/63; 345/204

(58) Field of Classification Search ..... 345/60, 345/61, 62, 63, 64, 65, 66, 581, 589, 616, 345/67, 68, 69, 204
See application file for complete search history.

(56) References Cited

U.S. PATENT DOCUMENTS 5,530,561 A * 6/1996 Shimazaki ..... 358/3.03
6,556,214 B1 * 4/2003 Yamada et al. ..... 345/616

* cited by examiner

*Primary Examiner*—Bipin Shalwala
*Assistant Examiner*—Afroza Y Chowdhury
(74) *Attorney, Agent, or Firm*—Ked & Associates, LLP

(57) ABSTRACT

The present invention relates to a driving method and apparatus of a plasma display panel. The driving method including the steps of: checking whether or not a first input grayscale data can be expressed through a certain pixel on the panel; in case the first grayscale data cannot be expressed, outputting a second grayscale data adjacent to the first grayscale data; and respectively multiplying erroneous data corresponding to a difference between the first grayscale data and the second grayscale data with preset coefficient values to diffuse the multiplied result to a plurality of pixels adjacent to the pixel, wherein before the erroneous data are respectively multiplied with the preset coefficient values, a random value is multiplied to at least one coefficient value among the plurality of coefficient values.

17 Claims, 7 Drawing Sheets

Fig. 2
Related Art

| Sub-field / Gray-scale / Weighted value | SF1 | SF2 | SF3 | SF4 | SF5 | SF6 | SF7 | SF8 | SF9 | SF10 |
|---|---|---|---|---|---|---|---|---|---|---|
| | 1 | 3 | 6 | 12 | 19 | 26 | 34 | 42 | 51 | 61 |
| 0 | | | | | | | | | | |
| 1 | ○ | | | | | | | | | |
| 2 | • | • | • | • | • | • | • | • | • | • |
| 3 | | ○ | | | | | | | | |
| 4 | ○ | ○ | | | | | | | | |
| 5 | • | • | • | • | • | • | • | • | • | • |
| 6 | | | ○ | | | | | | | |
| 7 | ○ | | ○ | | | | | | | |
| 8 | • | • | • | • | • | • | • | • | • | • |
| 9 | | ○ | ○ | | | | | | | |
| 10 | ○ | ○ | ○ | | | | | | | |
| 11 | • | • | • | • | • | • | • | • | • | • |
| ⋮ | ⋮ | ⋮ | ⋮ | ⋮ | ⋮ | ⋮ | ⋮ | ⋮ | ⋮ | ⋮ |

DRIVING METHOD AND APPARATUS OF PLASMA DISPLAY PANEL

BACKGROUND OF THE INVENTION

1. Field of the Invention

The present invention relates to a plasma display panel, and more particularly, to a driving method and apparatus of a plasma display panel in which a screen quality is improved.

2. Description of the Related Art

Recently, a plasma display panel (Hereinafter, referred to as "PDP") is gaining a popularity as a slim and light display device. The PDP varies light emission times in proportion to a video signal (for example, a television signal) to display an image. In detail, the video signal is digitalized, and digitalized video data is divided into a sub-field period according to a bit number. For each sub-field period, the light emission is performed at the number of times (for example, the number of sustain pulses) proportional to a luminance weighted value of the digital video data to express a grayscale.

For example, in case eight bits of video data are used to express the image using 256 grayscales, as shown in FIG. 1, an expression period for one frame (for example, 1/60 second=about 16.7 msec) is divided into eight sub-fields (SF1 to SF8). Each of the sub-field (SF1 to SF8) is again divided into a reset period (RP), an address period (AP) and a sustain period (SP). Herein, the reset period (RP) and the address period (AP) are identically allocated every sub-field, whileas the sustain period (SP) is increased at a ratio of 1:2:4:8:16:32:64:128.

The PDP driven using the above sub-field driving method duplicates a light emitted from each sub-field to display the image corresponding to a grayscale value.

However, in the conventional PDP driving method, an inconsistency between a visual property perceived by a human eye and an integral direction of the light causes a false contour noise to be generated. The false contour noise is generally observed in a format of a white stripe or a black stripe. The false contour noise is mainly generated in case grayscale levels having greatly different light emission patterns are continuously expressed such as "grayscale 127—grayscale 128", "grayscale 63—grayscale 64", "grayscale 3—grayscale 32" and the like. Herein, in case the light emission pattern is varied from a grayscale 128 to a grayscale 127, a brightness difference is "1" between two frames. However, as shown in FIG. 1, all of the $1^{st}$ to $7^{th}$ sub-fields (SF1 to SF7) of one frame are emitted in case the grayscale value of 127 is expressed, whileas only the $8^{th}$ sub-field of one frame is emitted in case the grayscale value of 128 is expressed. That is, in case the light emission pattern is varied from the grayscale 128 to the grayscale 127, the time difference between the light emission patterns between the two frames become large, and the large time difference causes positions of light emission centers between respective frames to be greatly deviated from one another thereby generating the false contour noise.

Accordingly, the conventional art uses a control method of the luminance weighted value every sub-field so as to reduce the false contour noise. That is, the conventional art sets the luminance weighted value every sub-field at a ratio of 1:3:6:12:19:26:34:42:51:61 to reduce the false contour noise (actually, various luminance weighted values are used). If the luminance weighted value is set, the light emission pattern is not varied greatly and accordingly, the false contour noise can be reduced.

However, in case the luminance weighted value is set at the ratio of 1:3:6:12:19:26:34:42:51:61, there is a drawback in that a non-expressible grayscale value is generated thereby reducing a grayscale reappearance. That is, as shown in FIG. 2, when the luminance weighted value is set at the ratio of 1:3:6:12:19:26:34:42:51:61, many grayscales are not expressed including a grayscale of "2", a grayscale of "5", a grayscale of "8", a grayscale of "11" and the like.

Accordingly, in case there is the non-expressible grayscale value using the above-set luminance weighted value, an error diffusion method can be used to express the non-expressible grayscale value. The error diffusion method is a method where a level difference between the non-expressible grayscale value and an expressible grayscale value is spatially diffused to express a certain grayscale value. In order to obtain the certain grayscale value using the error diffusion method, a diffusion circuit of FIG. 3 is used.

FIG. 3 is a view illustrating a conventional error diffusion circuit for performing error diffusion.

Referring to FIG. 3, the conventional error diffusion circuit 20 includes a lookup table 24 and an error diffusion unit 50. The expressible grayscale values using the luminance weighted values (for example, 1:3:6:12:19:26:34:42:51:61) are stored in the lookup table 24 as shown in FIG. 2. The lookup table 24 outputs a certain grayscale value correspondingly to an input grayscale value (data). The lookup table is illustrated as one example.

It does not matter that the lookup table employs any method where the certain grayscale value can be outputted corresponding to the input grayscale value.

The error diffusion unit 50 includes a subtractor 22, a plurality of delay elements 26, 28, 30 and 32, a plurality of multipliers 34, 36, 38 and 40, adders 42 and 44 and the like.

The subtractor 22 subtracts an output grayscale value of the lookup table 24 from the input grayscale value outputted from the adder 44 to output an erroneous value.

The plurality of delay elements 26, 28, 30 and 32 diffuses the erroneous values to peripheral pixels adjacent to a pixel expressing the output grayscale value. That is, the first delay element 26 delays the erroneous value by one pixel to output the delayed value therefrom. At this time, the first delay element 26 includes a memory having a size of storing data of one pixel. The second delay element 28 delays the erroneous value by (one horizontal line+one pixel) to output the delayed value therefrom. At this time, the second delay element 28 includes a memory having a size of storing data of (one horizontal line+one pixel). The third delay element 30 delays the erroneous value by one horizontal line to output the delayed value therefrom. At this time, the third delay element 30 includes a memory having a size of storing data of one horizontal line. The fourth delay element 32 delays the erroneous value by (one horizontal line−one pixel) to output the delayed value therefrom. At this time, the fourth delay element 32 includes a memory having a size of storing data of (one horizontal line−one pixel).

The multipliers 34, 36, 38 and 40 multiply the erroneous values respectively delayed from the plurality of delay elements 26, 28, 30 and 32 with certain coefficient values (K1 to K4) to output the multiplied values therefrom. Herein, the certain coefficient value is set as a value satisfying an equation of K1+K2+K3+K4=1. For example, as shown in FIG. 7, K1, K2, K3 and K4 can be respectively set to 7/16, 1/16, 5/16 and 3/16.

The first adder 42 adds each of the multiplied values outputted from the multipliers 34, 36, 38 and 40 to one another. The second adder 44 adds the grayscale value inputted from an external with the grayscale value (erroneous value) outputted from the first adder 42. The above added grayscale value can be outputted as a corresponding grayscale value by the lookup table 24.

An operation procedure of the diffusion circuit 20 is in detail described.

First, data corresponding to the certain grayscale value is inputted from the external. This grayscale value is inputted to the lookup table 24 via the second adder 44. At this time, the erroneous value outputted from the second adder 44 is regarded to be "0". In case the input grayscale value is "1", the lookup table 24 outputs the grayscale value of "1" therefrom. The grayscale value outputted from the lookup table 24 is expressed through a certain pixel on a panel of the PDP. At the same time, the subtractor 22 subtracts the input grayscale value before being inputted to the lookup table 24 and the output grayscale value outputted from the lookup table 24 to provide a certain erroneous value. Herein, since the input grayscale value and the output grayscale value of the lookup table 24 are all "1", the subtractor 22 outputs the erroneous value corresponding to "0" therefrom. Accordingly, the error diffusion unit 50 no longer performs the error diffusion.

Next, if the grayscale value of "2" is inputted from the external, the grayscale value of "2" does not exist at the lookup table 24. That is, in case the luminance weighted values of FIG. 2 are provided, the grayscale value of "2" cannot be expressed. In this case, the lookup table 24 outputs the grayscale value of "1" that is closest to the grayscale value of "2". At this time, in case the output grayscale value corresponding to any specific input grayscale value does not exist, the lookup table 24 selects the grayscale value that is closest to the input grayscale value, among the grayscale values less than the input grayscale value, as the output grayscale value. Accordingly, the grayscale value of "1" outputted from the lookup table 24 is expressed through a corresponding pixel.

At this time, the subtractor 22 outputs the erroneous value of "1" obtained by subtracting the grayscale value "1" from the grayscale of "2".

Additionally, the erroneous value is diffused to the peripheral pixels adjacent to the pixel expressing the grayscale value of "1" by each of the delay elements 26, 28, 30 and 32.

Meanwhile, each of the multipliers 34, 36, 38 and 40 multiplies the erroneous value with predetermined coefficient values 7/16, 1/16, 5/16 and 3/16.

The multiplied erroneous values are all added to one another by the first adder 42, and then are added to a next inputted grayscale value by the second adder 44. The above added grayscale value is again inputted to the lookup table 24.

As described above, the conventional error diffusion circuit spatially diffuses the level difference between grayscale data inputted and grayscale data converted at the lookup table 24. Accordingly, the erroneous value of the adjacent pixels of FIG. 5 is diffused and inputted to the pixels. The error diffusion method is applied to an entire screen of the PDP to be expressed on a human's eye as if an original pixel luminance, that is, a before-conversion grayscale level is expressed. Accordingly, the conventional art can express a high definition image having various grayscale levels without the false contour.

However, since the conventional error diffusion method uses the coefficient values allocated with certain weighted values, that is, 7/16, 1/16, 5/16 and 3/16 to diffuse the error, the patterned noise is generated. In other words, since the error diffusion is performed using a fixed coefficient value such that the error diffusion has a repetition property, the patterned noise is generated. Accordingly, the conventional art has a drawback in that the patterned noise causes the screen quality to be remarkably deteriorated.

SUMMARY OF THE INVENTION

Accordingly, the present invention is directed to a driving method and apparatus of a plasma display panel that substantially obviates one or more problems due to limitations and disadvantages of the related art.

An object of the present invention is to provide a driving method and apparatus of a plasma display panel in which a non-repetitive error is diffused using at least one random value so that a patterned noise can be suppressed thereby improving a screen quality.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a driving method of a plasma display panel, the driving method including the steps of: checking whether or not a first input grayscale data can be expressed through a certain pixel on the panel; in case the first grayscale data cannot be expressed, outputting a second grayscale data adjacent to the first grayscale data; and respectively multiplying erroneous data corresponding to a difference between the first grayscale data and the second grayscale data with preset coefficient values to diffuse the multiplied result to a plurality of pixels adjacent to the pixel, wherein before the erroneous data are respectively multiplied with the preset coefficient values, a random value is multiplied to at least one coefficient value among the plurality of coefficient values.

In another aspect of the present invention, there is provided a driving method of a plasma display panel in which erroneous data for a certain pixel is diffused to a plurality of pixels adjacent to the pixel, the driving method including the steps of: generating at least one random value; respectively multiplying the at least one random value to at least one coefficient value; and respectively multiplying the plurality of coefficient values multiplied with the at least one random value, with the erroneous data.

In a further another aspect of the present invention, there is provided a driving apparatus of a plasma display panel, the driving apparatus including: a unit for checking whether or not a first input grayscale data can be expressed through a certain pixel on the panel; a unit for calculating erroneous data corresponding between the first grayscale data and a second grayscale data adjacent to the first grayscale data in case the first grayscale data cannot be expressed; a plurality of diffusion units for diffusing the calculated erroneous data to the plurality of pixels adjacent to the pixel; a plurality of multiplying units for respectively multiplying erroneous data respectively outputted from the plurality of diffusion units with preset coefficient values; a first adding unit for adding multiplied values respectively outputted from the plurality of multiplying units, to one another; a second adding unit for adding the added values outputted from the first adding unit with a third grayscale data inputted next to the first grayscale data; and at least one random generating unit for generating at least one random value to supply the generated random value to at least one multiplying unit among the plurality of multiplying units.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 2 is a view illustrating one example of a grayscale value depending on a luminance weighted value of a plasma display panel;

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
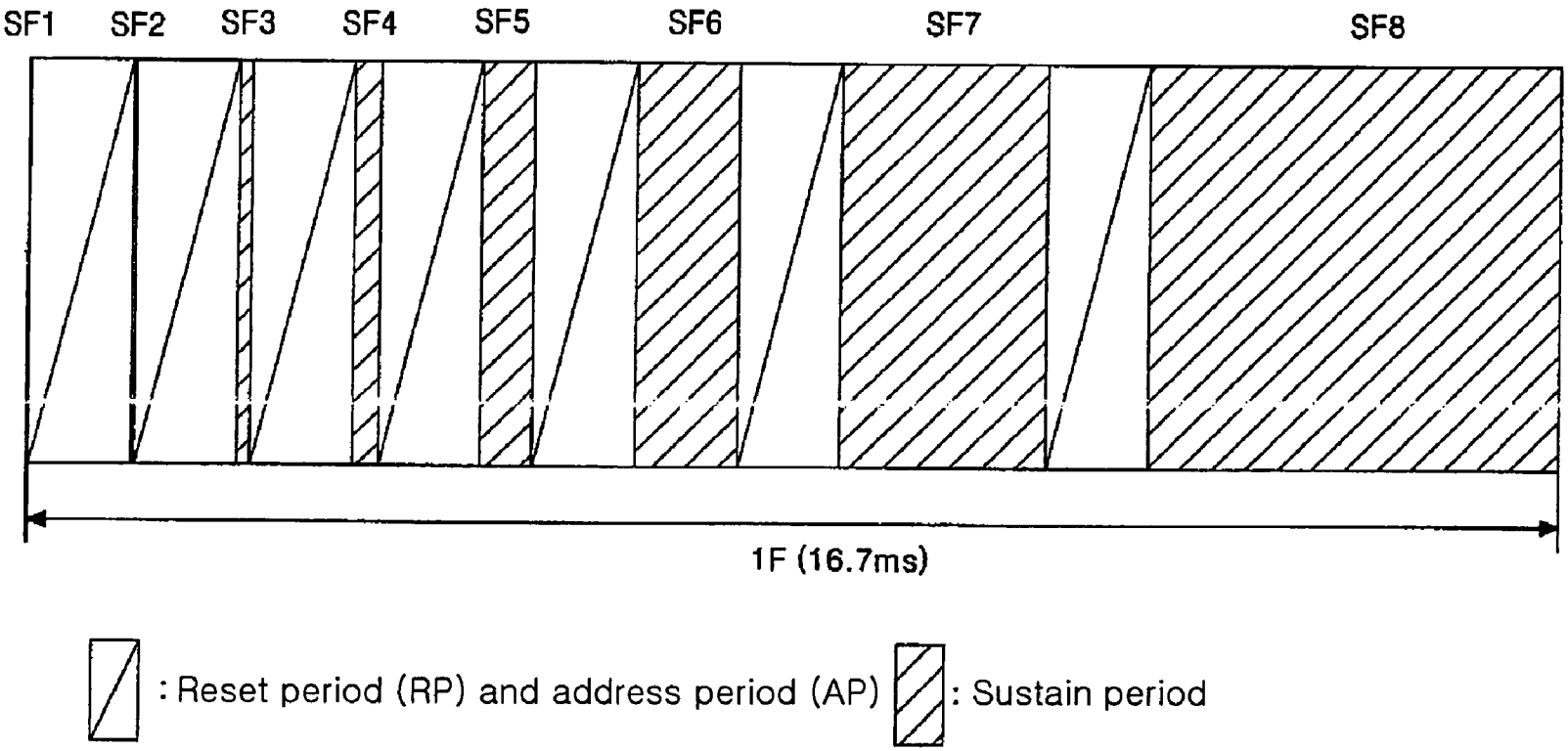
Fig. 1 Related Art
FIG. 1 is a view illustrating one frame of a conventional plasma display panel.
Figure 3:
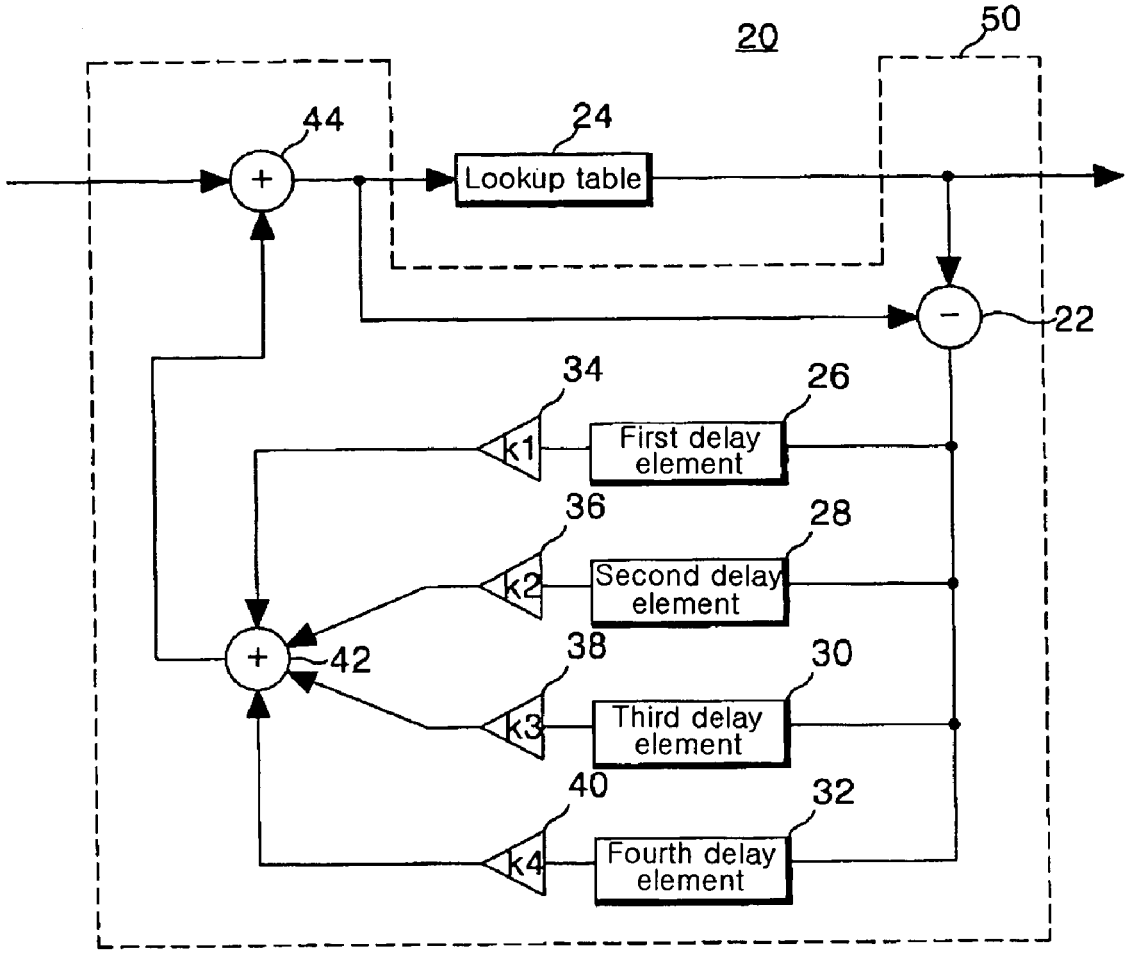
Fig. 3 Related Art
FIG. 3 is a view illustrating a conventional error diffusion circuit for performing an error diffusion.
Figure 4:
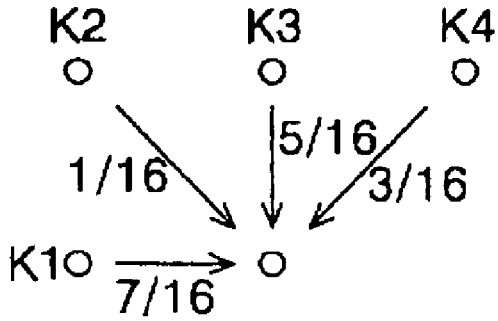
Fig. 4 Related Art
FIGS. 4 and 5 are views illustrating a diffusion of an erroneous value to an adjacent pixel.
Figure 5:
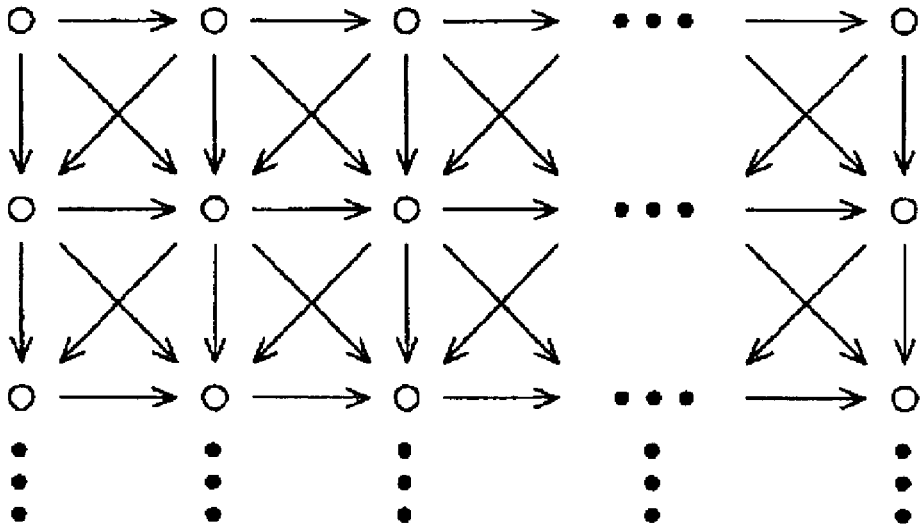
Fig. 5 Related Art
Figure 6:
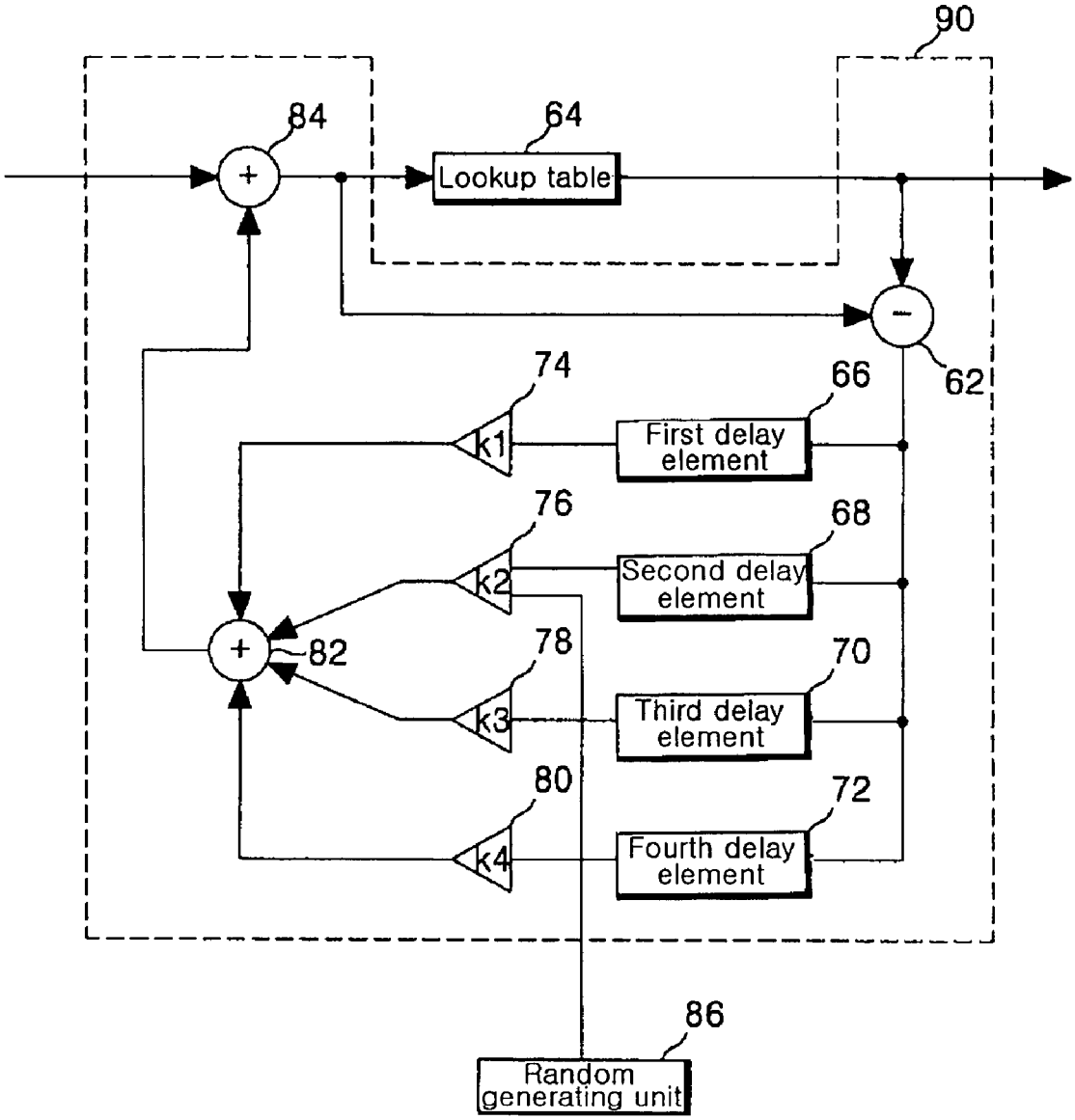
FIG. 6 is a view illustrating an error diffusion circuit having one random generating unit according to a first embodiment of the present invention.

FIG. 6 is a view illustrating an error diffusion circuit having one random generating unit according to a first embodiment of the present invention.

Referring to FIG. 6, the error diffusion circuit according to the first embodiment of the present invention includes a lookup table 64, an error diffusion unit 90 and a random generating unit 86.

The lookup table 64 stores expressible grayscale values using luminance weighted values (for example, 1:3:6:12:19:26:34:42:51:61) therein. The lookup table 64 outputs a certain grayscale value correspondingly to an input grayscale value. The lookup table 64 is illustrated as one example. It does not matter that the lookup table employs any way where the certain grayscale value can be outputted correspondingly to the input grayscale value. Meanwhile, as described beforehand, there are the grayscale values not expressed by the above-arranged luminance weighted values. That is, they are just a grayscale value of "2", a grayscale value of "5", a grayscale value of "8", a grayscale value of "11" and the like. If the above grayscale values are inputted to the lookup table 64, the lookup table 64 recognizes the input grayscale values as the grayscale values that cannot be displayed on a certain pixel, and outputs a similar grayscale value with the input grayscale value. That is, the lookup table selects the most closest grayscale value, that can be expressed using the luminance weighted values, among the grayscale values less than the input grayscale value to output the selected grayscale value as an output grayscale value for the input grayscale value. Instead, an error between the input grayscale value and the output grayscale value is used to perform the error diffusion.

The error diffusion unit 90 includes a subtractor 62, a plurality of delay elements 66, 68, 70 and 72, a plurality of multipliers 74, 76, 78 and 80, adders 82 and 84 and the like.

The subtractor 62 subtracts the output grayscale value of the lookup table 64 from the input grayscale value outputted from the adder 84 to output an erroneous value.

The plurality of delay elements 66, 68, 70 and 72 diffuses the erroneous values to peripheral pixels adjacent to a pixel expressing the output grayscale value. That is, the first delay element 66 delays the erroneous value by one pixel to output the delayed value therefrom. At this time, the first delay element 66 includes a memory having a size of storing data of one pixel. The second delay element 68 delays the erroneous value by (one horizontal line+one pixel) to output the delayed value therefrom. At this time, the second delay element 68 includes a memory having a size of storing data of one horizontal line+one pixel. The third delay element 70 delays the erroneous value by one horizontal line to output the delayed value therefrom. At this time, the third delay element 70 includes a memory having a size of storing data of one horizontal line. The fourth delay element 72 delays the erroneous value by (one horizontal line−one pixel) to output the delayed value therefrom. At this time, the fourth delay element 72 includes a memory having a size of storing data of one horizontal line−one pixel.

Figure 7:
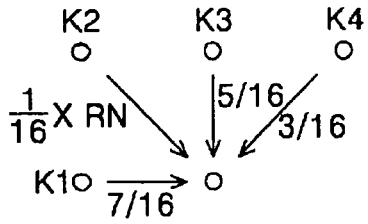
FIG. 7 is a view illustrating a diffusion of an erroneous value to an adjacent pixel using an error diffusion circuit of FIG. 6.

The multipliers 74, 76, 78 and 80 multiply the erroneous values respectively delayed by the plurality of delay elements with certain coefficient values (K1 to K4) to output the multiplied values therefrom. Herein, the certain coefficient values are set as values satisfying an equation of K1+K2+K3+K4=1. For example, as shown in FIG. 7, K1, K2, K3 and K4 can be respectively set to 7/16, 1/16, 5/16 and 3/16. However, this is illustrated as one example. It does not matter that the certain coefficient value is arbitrarily set as any one of 1/16 to 16/16. Herein, a denominator is set to 16, but it can be set to 32 or 64 according to need.

At this time, a random value (RN) provided from the random generating unit 86 is inputted to the second multiplier 76 such that the random value is multiplied with the delayed erroneous value and the coefficient value for output. Accordingly, the coefficient value of the second multiplier 76 is randomly varied according to the random value. Herein, the random generating unit 86 can randomly output any one of the numbers of 1 to 16. By randomly varying one coefficient value among the certain coefficient values, a patterned noise can be prevented from being generated at the time of the error diffusion. If the denominators of the coefficient values of the multipliers 74, 76, 78 and 80 are set to 32, the random generating unit 86 can output any one of the numbers of 1 to 32. Further, the denominators of the coefficient values of the multipliers 74, 76, 78 and 80 are set to 64, the random generating unit 86 can output any one of the numbers of 1 to 64.

Figure 8:
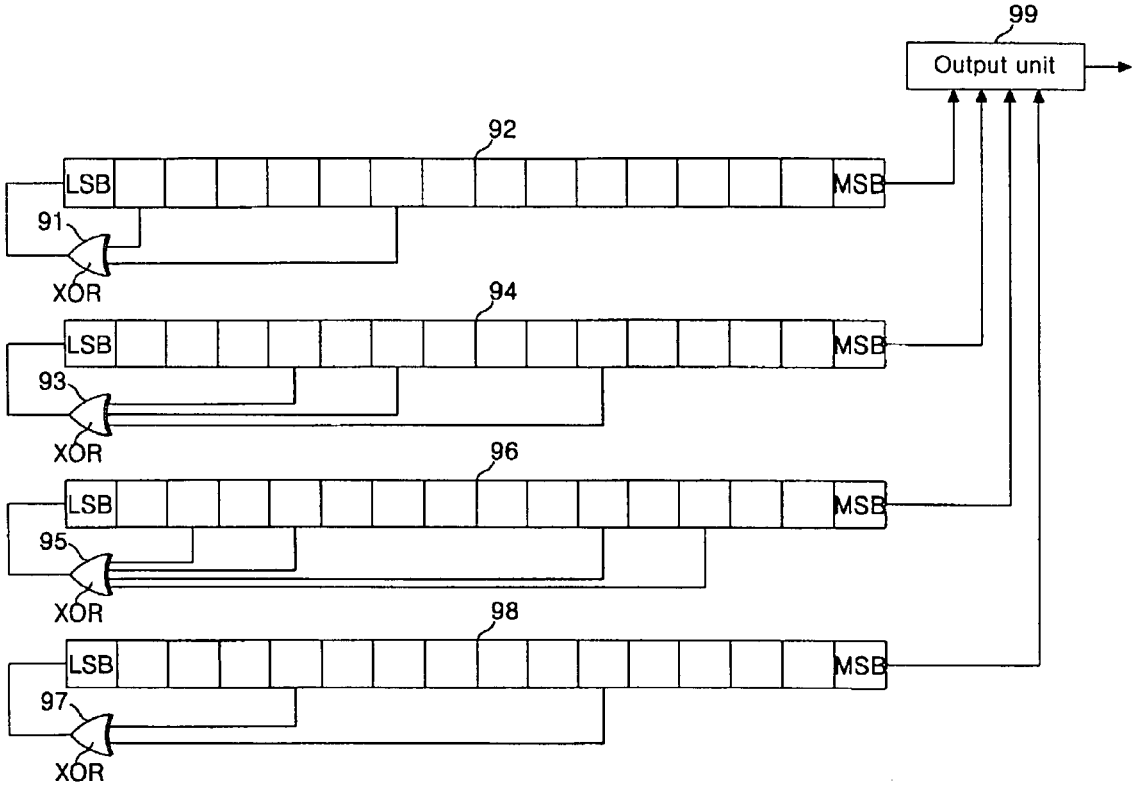
FIG. 8 is a view illustrating a detailed construction of a random generating unit of FIG. 6.

As shown in FIG. 8, the random generating unit 86 includes shift registers 92, 94, 96 and 98 each being comprised of 16 bits; exclusive logical sum (XOR) gates 91, 93, 95 and 97 respectively connected to the shift registers 92, 94, 96 and 98; and an output unit 99 for outputting the random value generated by combining bit values respectively outputted from the shift registers 92, 94, 96 and 98.

Herein, the shift registers 92, 94, 96 and 98 are respectively comprised of 16 bits, but each of the shift registers 92, 94, 96 and 98 can be constructed to have a size of at least 2 bits, preferably a size of 16 bits or more.

At this time, at least one of the shift registers 92, 94, 96 and 98 should be set to one bit at an initial time, all not being to zero bit. Of course, the bit values arranged at each of the shift registers 92, 94, 96 and 98 can be identical or not.

The exclusive logical sum gates 91, 93, 95 and 97 are provided by one every shift register. It is desirable that the exclusive logical sum gates 91, 93 95 and 97 includes input terminals respectively connected to prime-numbered bits of the shift register, and output terminals connected to a least significant bit of the shift register. At this time, it is desirable that each of the input terminals of the exclusive logical sum gates 91, 93, 95 and 97 is connected to at least two bits of the shift register. For example, as shown in FIG. 8, a second bit and a seventh bit of the first shift register 92 can be respectively connected to the input terminal of the first exclusive logical sum gate 91. A fifth bit, a seventh bit and an eleventh bit of the second shift register 94 can be respectively connected to the input terminal of the second exclusive logical sum gate 93. A third bit, a fifth bit, an eleventh bit and a thirteenth bit of the third shift register 96 can be respectively connected to the input terminal of the third exclusive logical sum gate 93. A fifth bit and an eleventh bit of the fourth shift register 98 can be respectively connected to the input terminal of the fourth exclusive logical sum gate 97. As described above, it is desirable that each of the input terminals of the exclusive logical sum gates 91, 93, 95 and 97 is connected to at least two bits of a corresponding shift register, and the connected bits are prime-numbered in position. For example, prime-numbered bits correspond to $1^{st}$, $3^{rd}$, $5^{th}$, $7^{th}$, $8^{th}$, $11^{th}$ and $13^{th}$ bits among the bits of 1 to 16.

At this time, values corresponding to most significant bits of respective shift registers 92, 94, 96 and 98 are outputted to the output unit 99. The output unit 99 can combine the values outputted from the most significant bits of each of the shift registers 92, 94, 96 and 98 to generate certain random values. Accordingly, the output unit 99 is comprised of a size of 4 bits. For example, assuming that bit values respectively outputted from the most significant bits of the first to fourth shift registers 92, 94, 96 and 98 are "1", "0", "0" and "1", the output unit 99 combines the outputted bit values with "1001" to provide the random value of "9" for the second multiplier.

An operation of the above-constructed random generating unit 86 is briefly described.

Certain values are stored in respective bits of the shift registers 92, 94, 96 and 98. After that, the shift registers 92, 94, 96 and 98 are shifted to the right by one bit using a certain system clock (not shown). At this time, the exclusive logical sum gates 91, 93, 95 and 97 receive the certain values from the prime-numbered bits of the respective shift registers 92, 94, 96 and 98, and input the certain values to the respective shift register 92, 94, 96 and 98 correspondingly to the received values. For example, the exclusive logical sum gates 91, 93, 95 and 97 output "1" when the number of "1" is an odd number among the received values, and output "0" when the number of "1" is an even number (or when there is no "1"). Accordingly, the output unit 99 combines the values outputted from the most significant bits of the respective shift registers 92, 94, 96 and 98 to generate the random value. The above random value can be any one of 1 to 16. Therefore, it is obvious that if the shift registers 92, 94, 96 and 98 and the exclusive logical sum gates 91, 93, 95 and 97 are increased in numbers, more random values can be generated.

The first embodiment of the present invention describes that the random value provided from the random generating unit 86 is provided for the second multiplier 76, but the present invention is not limited to this and the random value generated from the random generating unit 86 can be provided for any one of the first to fourth multipliers 74, 76, 78 and 80. That is, the random value generated from the random generating unit 86 can be provided only for the first multiplier 74, and can be provided only for the second multiplier 76, and can be provided only for the third multiplier 78, and can be provided only for the fourth multiplier 80.

In the meanwhile, the first adder 82 adds respective multiplied values outputted from the multipliers 74, 76, 78 and 80 to one another. At this time, one of the multiplied values outputted from the multipliers 74, 76, 78 and 80 is a value additionally multiplied by the random value provided from the random generating unit 86. The second adder 84 adds the grayscale value inputted from an external with the grayscale value (that is, the erroneous value) outputted from the first adder 82. The above added grayscale value can be outputted as a corresponding grayscale value by the lookup table 64.

An operation procedure of the above error diffusion circuit is in detail described.

First, data corresponding to a certain grayscale value is inputted from the external. This grayscale value is inputted to the lookup table 64 via the second adder 84. At this time, the erroneous value outputted from the second adder 84 is regarded to be zero. In case the input grayscale value is "1", the lookup table 64 outputs the grayscale value of "1". The grayscale value outputted from the lookup table 64 is displayed through a certain pixel on the panel of the PDP. At the same time, the subtractor 62 subtracts the input grayscale value before being inputted to the lookup table 64 and the output grayscale value outputted from the lookup table 64 to provide a certain erroneous value. Herein, since the input grayscale value and the output grayscale value of the lookup table 64 are all "1", the subtractor outputs the erroneous value corresponding to "0". Accordingly, the error diffusion unit 90 no longer performs the error diffusion.

Next, if the grayscale value of "2" is inputted from the external, the grayscale value of "2" does not exist at the lookup table 64. In this case, the lookup table 64 outputs the grayscale value of "1" being closest to the grayscale value of "2". At this time, in case the output grayscale value corresponding to any specific input grayscale value does not exist, the lookup table 64 selects the grayscale value that is closest to the input grayscale value, among the grayscale values less than the input grayscale value, as the output grayscale value. Accordingly, the grayscale value of "1" outputted from the lookup table 64 is expressed through a corresponding pixel. At this time, the subtractor 62 outputs the erroneous value of "1" obtained by subtracting the grayscale value of "1" from the grayscale value of "2".

Additionally, the erroneous value is diffused to the peripheral pixels adjacent to the pixel expressing the grayscale value of "1" by respective delay elements 66, 68, 70 and 72.

Meanwhile, each of the multipliers 74, 76, 78 and 80 respectively multiplies the erroneous value with the predetermined coefficient values 7/16, 1/16, 5/16 and 3/16. At this time, one of the multipliers 74, 76, 78 and 80 allows the value obtained by multiplying the random value provided from the random generating unit 86 with the certain coefficient value to be again multiplied with the erroneous value.

The erroneous values multiplied through each of the multipliers 74, 76, 78 and 80 are all added to one another by the first adder 82, and then are added to a next input grayscale value by the second adder 84. The above added grayscale value is again inputted to the lookup table 64.

Accordingly, the error diffusion circuit according to the first embodiment of the present invention is constructed to allow the random value generated from the random generating unit to be inputted to one of the multipliers such that, at the time of the error diffusion, the random value is multiplied with the certain coefficient value before the erroneous value is multiplied to the certain coefficient value of the multiplier, and then the above multiplied value is again multiplied with the erroneous value. Therefore, the error is not diffused with a repetitive value thereby preventing a generation of the patterned noise.

In the meanwhile, the present invention is constructed to provide at least two random generating units for respectively generating at least two random values such that the at least two random values can be provided for at least two multipliers.

Figure 9:
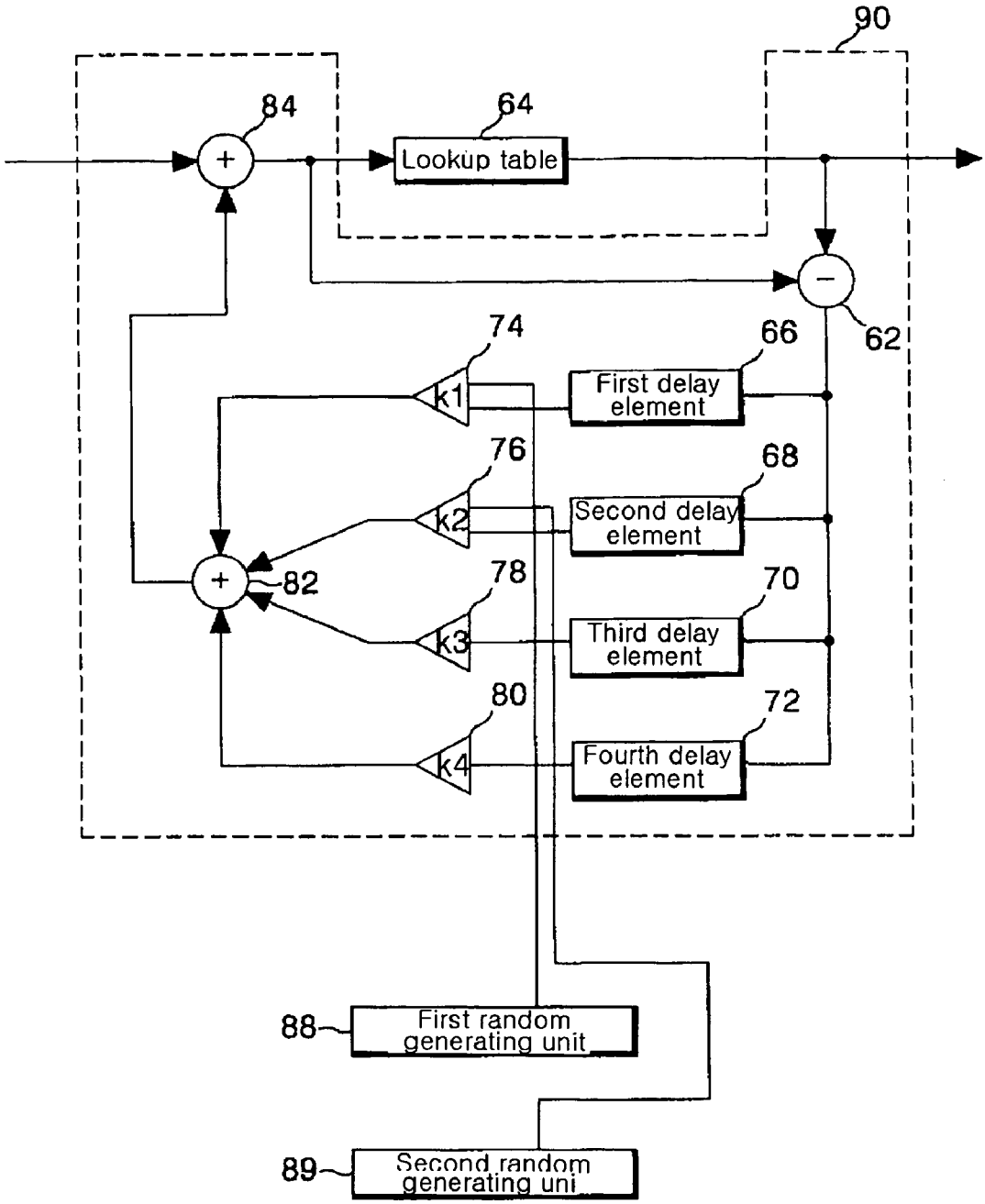
FIG. 9 is a view illustrating an error diffusion circuit having two random generating units according to a second embodiment of the present invention.

FIG. 9 is a view illustrating an error diffusion circuit having two random generating units according to a second embodiment of the present invention.

As shown in FIG. 9, the error diffusion circuit according to the second embodiment of the present invention has all the same structure elements as the error diffusion circuit of FIG. 6, but provides two random generating units 88 and 89 respectively connected to first and second multipliers 74 and 76. Of course, the two random generating units 88 and 89 can be connected to two multipliers among first to fourth multipliers 74, 76, 78 and 80. Further, the random generating unit can be also provided as many as the number of the multipliers.

Accordingly, only coefficient value of the second multiplier is randomly varied in FIG. 6, whileas a coefficient value of the first multiplier 74 as well as a coefficient value of the second multiplier 76 can be also randomly varied in FIG. 9. If the random generating unit is provided as many as the number of the multipliers, all the coefficient values of the multipliers will be randomly varied.

As such, at least two random generating units are provided to be connected to at least two multipliers such that the coefficient values of the connected multipliers are randomly varied thereby preventing the patterned noise.

As described above, the driving apparatus of the plasma display panel according to the present invention can use the random value provided from at least one random generating unit to randomly vary the coefficient values of the multipliers such that the patterned noise is prevented to be generated thereby improving the screen quality.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A driving method of a plasma display panel, the driving method comprising:

checking whether or not a first input grayscale data can be expressed through a certain pixel on the panel;

in case the first grayscale data cannot be expressed, outputting a second grayscale data adjacent to the first grayscale data; and respectively multiplying erroneous data corresponding to a difference between the first grayscale data and the second grayscale data with preset coefficient values to diffuse the multiplied result to a plurality of pixels adjacent to the pixel, wherein before the erroneous data are respectively multiplied with the preset coefficient values, a random value is multiplied to at least one coefficient value among the plurality of coefficient values.

2. The driving method according to claim 1, wherein each of the coefficient values is set as any one of 1/n to 1 when n is integer.

3. The driving method according to claim 1, wherein the random value is randomly generated as any one of 1 to n when n is integer.

4. The driving method according to claim 1, wherein each of the coefficient values is multiplied with random values different from one another.

5. The driving method according to claim 1, further comprising:

adding resultant values obtained by respectively multiplying the erroneous data with the coefficient values, to one another; and adding the added resultant values to a third grayscale data inputted next to the first grayscale data.

6. A driving apparatus of a plasma display panel, the driving apparatus comprising:

means for checking whether or not a first input grayscale data can be expressed through a certain pixel on the panel;

means for calculating erroneous data corresponding between the first grayscale data and a second grayscale data adjacent to the first grayscale data in case the first grayscale data cannot be expressed;

a plurality of diffusion means for diffusing the calculated erroneous data to the plurality of pixels adjacent to the pixel;

a plurality of multiplying means for respectively multiplying erroneous data respectively outputted from the plurality of diffusion means with preset coefficient values;

first adding means for adding multiplied values respectively outputted from the plurality of multiplying means, to one another;

second adding means for adding the added values outputted from the first adding means with a third grayscale data inputted next to the first grayscale data; and at least one random generating means for generating at least one random value to supply the generated random value to at least one multiplying means among the plurality of multiplying means.

7. The driving apparatus according to claim 6, wherein the checking means comprises a lookup table for storing a plurality of grayscale data, that can be expressed with a plurality of luminance weighted values, to output grayscale data corresponding to an input grayscale data.

8. The driving apparatus according to claim 6, wherein the checking means outputs a corresponding grayscale data in case the grayscale data corresponding to the input grayscale data exists at the lookup table.

9. The driving apparatus according to claim 6, wherein the checking means outputs grayscale data adjacent to the input grayscale data in case the grayscale data corresponding to the input grayscale data does not exist at the lookup table.

10. The driving apparatus according to claim 6, wherein the erroneous data is a value obtained by subtracting the second grayscale data from the first grayscale data.

11. The driving apparatus according to claim 6, wherein each of the plurality of diffusion means spatially delays the calculated erroneous data to diffuse the delayed data to the adjacent plurality of pixels.

12. The driving apparatus according to claim 6, wherein each of the plurality of multiplying means multiplies erroneous data, a coefficient value and a random value in case a random value is supplied from the at least one random generating means.

13. The driving apparatus according to claim 6, wherein in case the plurality of coefficient values are set as any one of 1/n to 1 when n is integer, the random value is randomly generated as any one of 1 to n.

14. The driving apparatus according to claim 6, wherein the at least one random generating means respectively comprises:

a plurality of shift registers comprised of a plurality of bits;

a plurality of exclusive logical sum gates respectively connected to the plurality of shift registers; and means for outputting a random value generated by combining bit values respectively outputted from the plurality of shift registers.

15. The driving apparatus according to claim 14, wherein the plurality of exclusive logical sum gates respectively has an input terminal connected to at least two bits among a plurality of bits of each of the plurality of shift registers, and an output terminal connected to a least significant bit of each of the plurality of shift registers.

16. The driving apparatus according to claim 14, wherein the each of the input terminals of the plurality of exclusive logical sum gates is connected to prime-numbered bits among a plurality of bits of each of the plurality of shift registers.

17. The driving apparatus according to claim 14, wherein an output value of the most significant bit of each of the plurality of shift registers is inputted to the output means.

* * * * *